US005085337A

United States Patent [19]

Kos

[11] Patent Number: 5,085,337

[45] Date of Patent: Feb. 4, 1992

[54] SHOCK RESISTANT GASKETING SYSTEM FOR LIQUID CONTAINERS

[75] Inventor: Chester M. Kos, Cross Junction, Va.

[73] Assignee: Rubbermaid Commercial Products Inc., Winchester, Va.

[21] Appl. No.: 527,953

[22] Filed: May 24, 1990

[51] Int. Cl.[5] ..... B65D 51/16

[52] U.S. Cl. ..... 220/204; 220/203; 220/324; 220/366; 220/367; 220/378; 220/89.1

[58] Field of Search ..... 110/378, 202, 203, 204, 110/340, 316, 324, 367, 89.1, 346, 354, 358, 366, 4.21, 4.24; 215/260, 270, 280, 307

[56] References Cited

U.S. PATENT DOCUMENTS

| | | | |
|---|---|---|---|
| 795,319 | 7/1905 | Vanderman | 220/378 X |
| 1,038,026 | 9/1912 | Thomas | 220/378 X |
| 1,520,784 | 12/1924 | Taylor | 220/378 X |
| 2,117,151 | 5/1938 | Cowan | 220/378 X |
| 2,117,228 | 5/1938 | Stuchbery | 220/378 X |
| 2,207,543 | 7/1940 | Knapp . | |
| 2,330,306 | 9/1943 | Murphy | 220/378 X |
| 2,475,836 | 7/1949 | Henricksen et al. | 220/378 X |
| 2,633,264 | 3/1953 | Dinsmore et al. . | |
| 3,044,658 | 7/1962 | Combs et al. | 220/378 X |
| 3,102,741 | 9/1963 | Lash | 220/378 X |
| 3,232,468 | 2/1966 | Rownd . | |
| 3,331,528 | 7/1967 | Racek | 220/378 X |
| 3,428,209 | 2/1969 | Brucker et al. | 220/378 |
| 3,464,579 | 9/1969 | Asenbauer | 220/378 X |
| 3,504,822 | 4/1970 | Haloski | 220/203 |
| 3,696,561 | 10/1972 | Harp et al. | 220/378 X |
| 3,811,747 | 5/1974 | Levin | 312/308 |
| 3,920,140 | 11/1975 | Kiser | 215/100 |
| 4,184,601 | 1/1980 | Stewart et al. . | |
| 4,489,840 | 12/1984 | De Freitas . | |
| 4,721,214 | 1/1988 | Wandel | 215/13.1 |
| 4,726,478 | 2/1988 | Zimmermann | 215/12.1 |
| 4,768,664 | 9/1988 | Zimmermann | 215/12.1 |
| 4,811,858 | 3/1989 | Augur | 215/13.1 |

FOREIGN PATENT DOCUMENTS

| | | | |
|---|---|---|---|
| 3406918 | 9/1985 | Fed. Rep. of Germany . | |
| 3611153 | 6/1987 | Fed. Rep. of Germany . | |
| 3804912 | 1/9189 | Fed. Rep. of Germany . | |
| 648451 | 3/1930 | France . | |
| 1050990 | 1/1954 | France | 220/378 |
| 548809 | 10/1956 | Italy | 220/378 |

*Primary Examiner*—Gary E. Elkins
*Assistant Examiner*—Stephen Cronin
*Attorney, Agent, or Firm*—Renner, Kenner, Greive, Bobak, Taylor & Weber

[57] ABSTRACT

A shock resistant gasketing system (10) for a liquid container (11) has a resilent gasket (14), a base (12) which has an enclosed area (20) therein, and a cover (13). A rim (25) defines an opening (26) into the enclosed area (20). The rim (25) has a retaining wall groove (30) and a gasket seat (27) contiguous with the opening into the enclosed area (20) and continguous with the retaining wall groove (30). The cover (13) is affixable to the base (12) and closes the opening (26) when the cover (13) is affixed to the base (12). Latches (40) can secure the cover (13) to the base (12). The cover (13) has a retaining wall (50) structurally corresponding to the retaining wall groove (30) of the base (12), such that the retaining wall (50) fits within the retaining wall groove (30) when the cover (13) is affixed to the base (12). The gasket (14) is positioned on the gasket seat (27) and is impinged between the base (12) and the cover (13) when the cover (13) is affixed to the base (12).

9 Claims, 4 Drawing Sheets

SHOCK RESISTANT GASKETING SYSTEM FOR LIQUID CONTAINERS

TECHNICAL FIELD

The present invention generally relates to sealing gaskets for liquid containers. More particularly, the present invention relates to a liquid container gasketing system which is resistant to a shock-induced build-up of pressure.

BACKGROUND ART

It is known in the gasket art that a resilient material, such as rubber or other polymeric compound, may be interposed between two closing surfaces in order to seal any spaces between the surfaces. Such a seal is intended to make the opposed surfaces air and liquid tight. Such gaskets are often employed in the liquid container art, wherein it is desired to prevent contained liquid from escaping from the container during storage or transit.

Liquid container gaskets, such as those encountered in the beverage container art, are often tubular, washer-like rubber elements which are placed on the rim of the container to be closed and sealed. A lid is then placed onto the container and fastened thereto, such that the gasket is interposed between the container and its lid. It is also a common practice to cause the lid to engage the container with some force, such that the interposed resilient gasket is compressed to some degree. The compression of the gasket, in turn, causes a more positive seal to be effected between the container and its lid. The degree to which such gaskets are compressed is often determined by how tight the lid is fitted to the container. For instance, when the lid has screw threads adapted to engage threads on the container, more turns of the lid onto the threads of the container results in a tighter seal.

It has been found that when a filled liquid container is dropped, the corresponding build-up of pressure from within the container is often sufficient to cause the gasket to be ejected from its normal position between the container and its lid. This condition is referred to as a "blow-out" which could well lead to potentially hazardous results, especially if the contained liquid is toxic or if it is being held at a high temperature.

One solution in the art to the hazard of a blowout has been to incorporate a venting system into the container, and/or its lid, in order to equalize internal and external pressures. While some venting systems have proved to be quite effective in accomplishing this task, it has been found that they are often inadequate to handle pressure build-up associated with larger liquid containers, such as those containing from three to five gallons of liquid or more. With these larger types of liquid containers, the internal pressures developed when the containers are accidentally dropped are often so large that a vent system cannot compensate for the sudden increases in pressure. At such times, the pressure is then directly exerted against the container lid, urging it away from the container itself. It is at this time that the danger of a blow-out is the greatest. Gasket and gasketing systems heretofore known in the art have proven incapable of consistently compensating for pressure increases of this kind.

It is also desirable to provide liquid containers which are easy to use and which can be molded using current molding technology. Obtrusive clamps, bolts and the like, while they may provide for secured lid closings and hence a decrease in blow-out potential, are likely to defeat the purpose of the storage container.

Therefore, a need exists for a gasketing system for a liquid container which is unobtrusive and yet possessed of an ability to prevent a blow-out even in the case of high pressure increases on the inside of the liquid container.

DISCLOSURE OF THE INVENTION

It is therefore an object of the present invention to provide a gasketing system for a liquid container.

It is another object of the invention to provide a gasketing system, as above, which will provide for increased shock resistance to the integrity of the container closing seal.

It is a further object of the present invention to provide a gasketing system, as above, which is unobtrusive as to the container itself.

These and other objects of the present invention, as well as the advantages thereof over existing prior art forms, which will become apparent from the description to follow, are accomplished by the means hereinafter described and claimed.

In general, a gasketing system according to the present invention is provided to seal a cover to a base container with a resilient gasket therebetween. The base includes an enclosed area and has a rim defining an opening into the enclosed area. The rim has a retaining wall groove and a seat contiguous with the opening into the enclosed area and contiguous with the retaining wall groove. The cover, when affixed to the base, closes the opening into the enclosed area. The cover has a retaining wall structurally corresponding to the retaining wall groove of the base, such that the retaining wall fits within the retaining wall groove when the cover is affixed to the base. The gasket is positioned on the gasket seat and is impinged between the base and the cover when the cover is affixed to the base.

A preferred exemplary gasketing system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
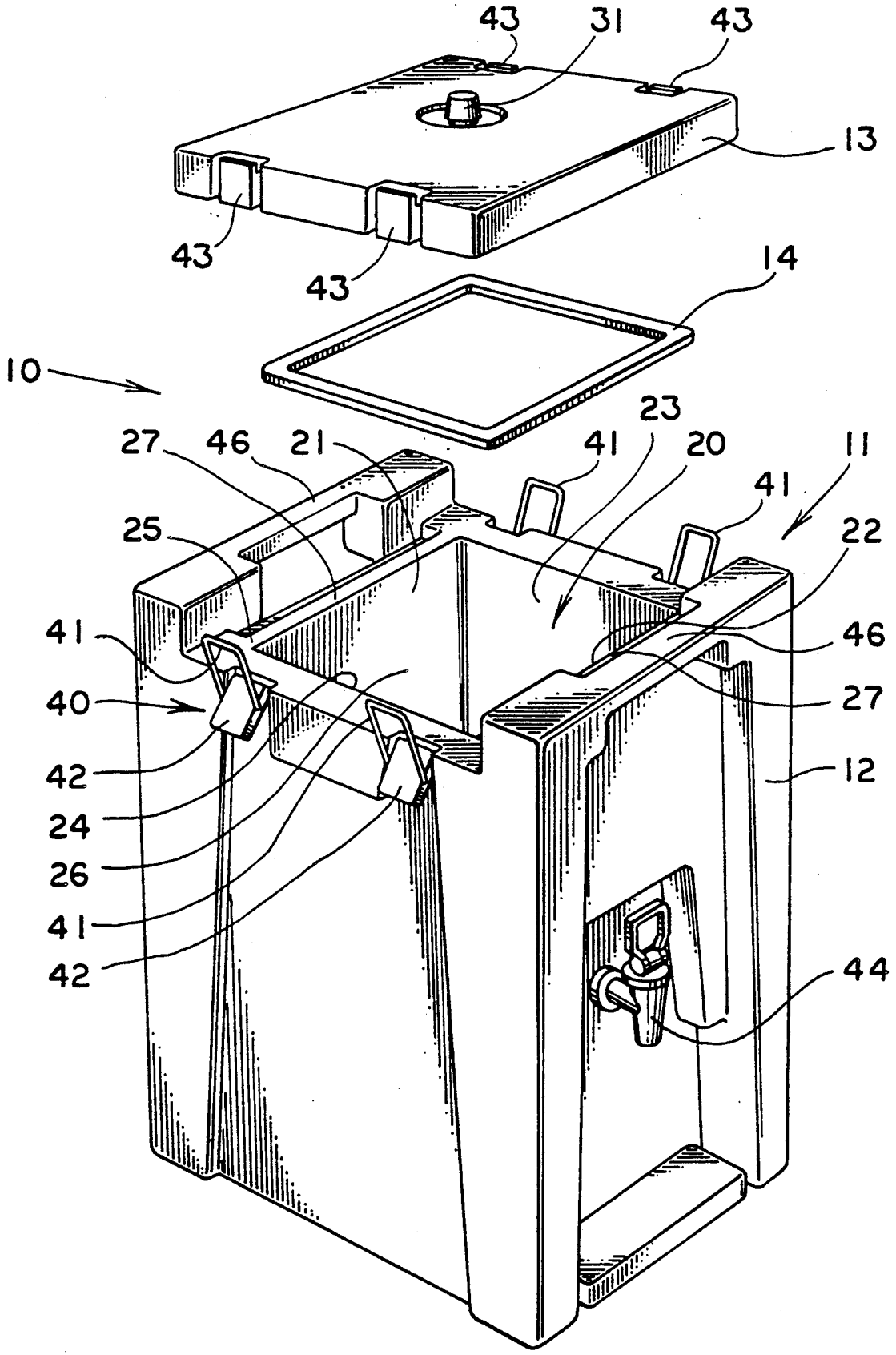
FIG. 1 is an exploded, perspective view of a gasketing system according to the present invention, and depicted in use with a beverage container having a base, a lid and a gasket therebetween.

A gasketing system according to the concepts of the present invention is generally indicated by the numeral 10 in FIG. 1. While the gasketing system 10 may be employed with a variety of liquid containers, it is shown on the attached drawings as used with a beverage container generally indicated by the numeral 11 and having a base 12 and a lid or cover 13. Although not a necessary limitation, base 12 and cover 13 are preferably fabricated from a polymeric material which may be molded employing current molding technology. The elements of the gasketing system 10, which will be described hereinbelow, may thus be integrally formed with the base 12 and cover 13 during the molding process.

Interposed between base 12 and cover 13, as will be more fully discussed hereinbelow, is a gasket 14. Gasket 14 is fabricated from a resilient material, preferably a rubber or other polymeric material.

Liquid container base 12 has an enclosed area, generally indicated by the numeral 20, where the contained liquid (not shown) is held. Base 12 and enclosed area 20 may be of numerous configurations, an example of which is shown in the drawings. As such, base 12 is depicted in the drawings as having a first pair of opposing sidewalls 21 and 22, and a second pair of opposing sidewalls 23 and 24 thereby defining enclosed area 20.

Figure 2:
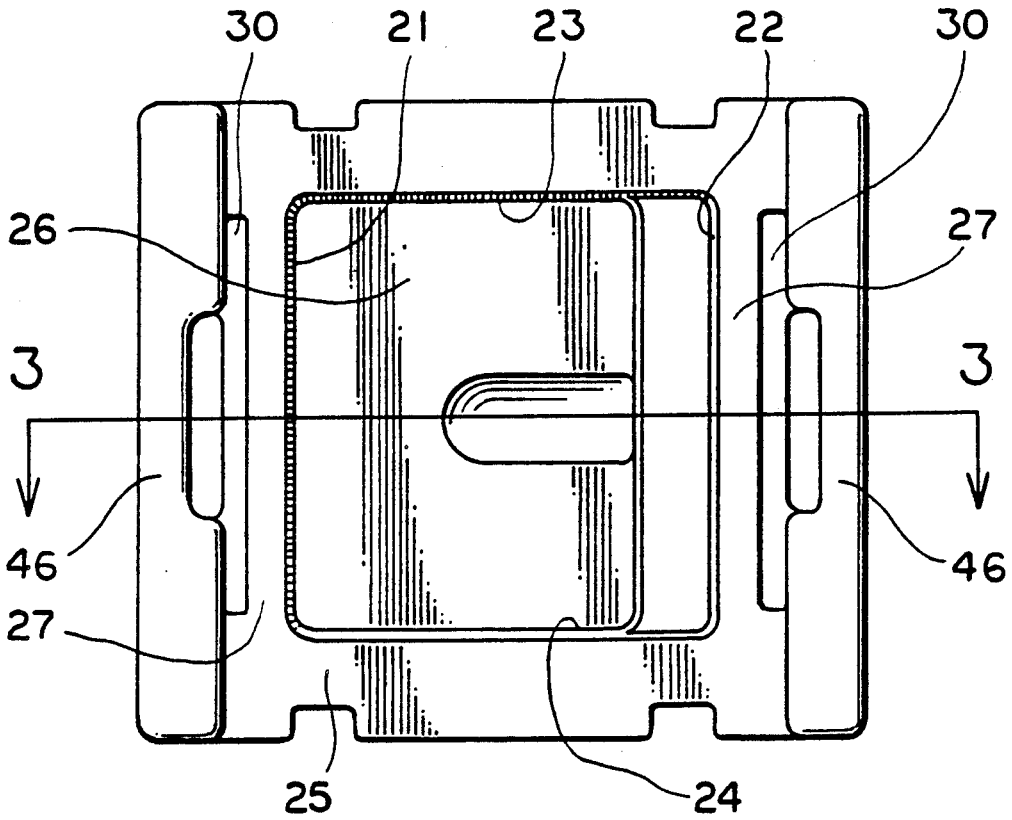
FIG. 2 is a top plan view of the base of FIG. 1.
Figure 4:
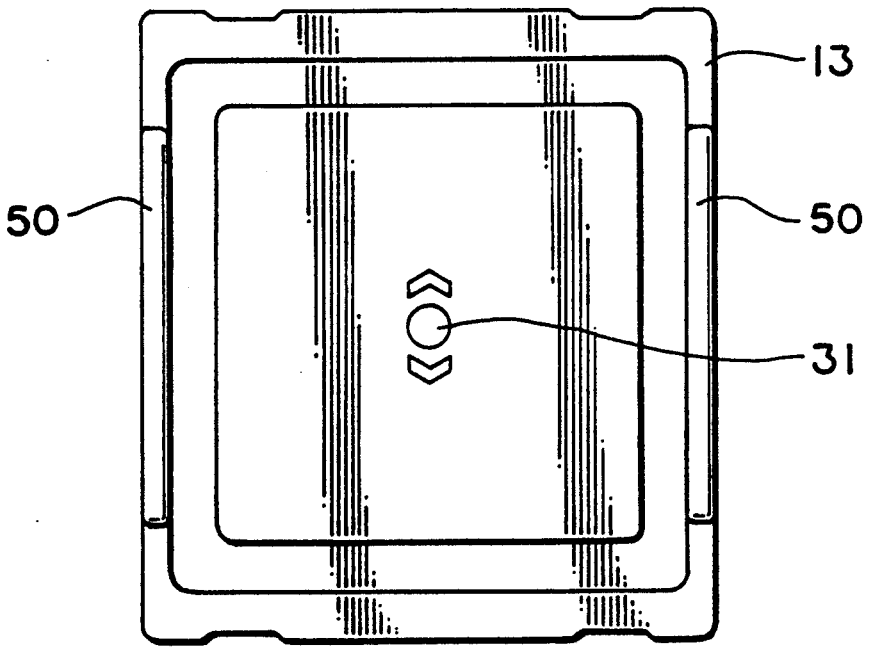
FIG. 4 is a bottom plan view of the lid of FIG. 1.

Base 12 is also provided with a rim 25 which defines the periphery of an opening 26 into enclosed area 20. A gasket receiving area 27, which is the portion of rim 25 at the top of sidewalls 21 and 22, forms a seat for gasket 14, as will be discussed hereinbelow. As best shown in FIG. 2, rim 25 is also provided with at least one retaining wall groove 30. Preferably, two retaining wall grooves 30 are each individually juxtaposed in the first pair of opposing sidewalls 21 and 22 adjacent to gasket receiving area 27. Further, as best shown in FIG. 2, the gasket seat formed at gasket receiving area 27 is contiguous with opening 26 into enclosed area 20, and is also contiguous with retaining wall groove 30.

Cover 13 may be provided with a vent 31 of the type, for example, shown in U.S. Pat. No. 4,909,408, to which reference is made for whatever details may be necessary to understand the present invention. When cover 13 is affixed to base 12, vent 31 allows internal pressure thereof to be equalized with the external pressure. However, as was also described above, in the case of a sudden increase in internal pressure, such as encountered when a filled liquid container having a base 12 and a cover 13 is dropped, vent 31 may prove inadequate to relieve the pressure. This, in turn, may cause the blow-out condition.

Cover 13 is configured so as to be affixable to base 12 and may be secured to base 12 in a variety of ways. For example, as shown in FIG. 1, a hook latch generally indicated by the numeral 40 and having a hook 41 and a housing 42, may be affixed to base 12. Further, cover 13 may be provided with a block 43 which is engageable by hook 41. When hook 41 engages block 43, and an operator exerts a force on housing 42, hook 41 causes a force to be exerted onto block 43. This, in turn, secures cover 13 to base 12. This type of latch 40 is well known in the art, and further, is merely exemplary of the numerous means available to secure cover 13 to base 12, all of such means being within the scope of the present invention. A plurality of hook latches 40 may be secured to base 12, and preferably are secured in juxtaposition with the second pair of opposing sidewalls 23 and 24.

Figure 3:
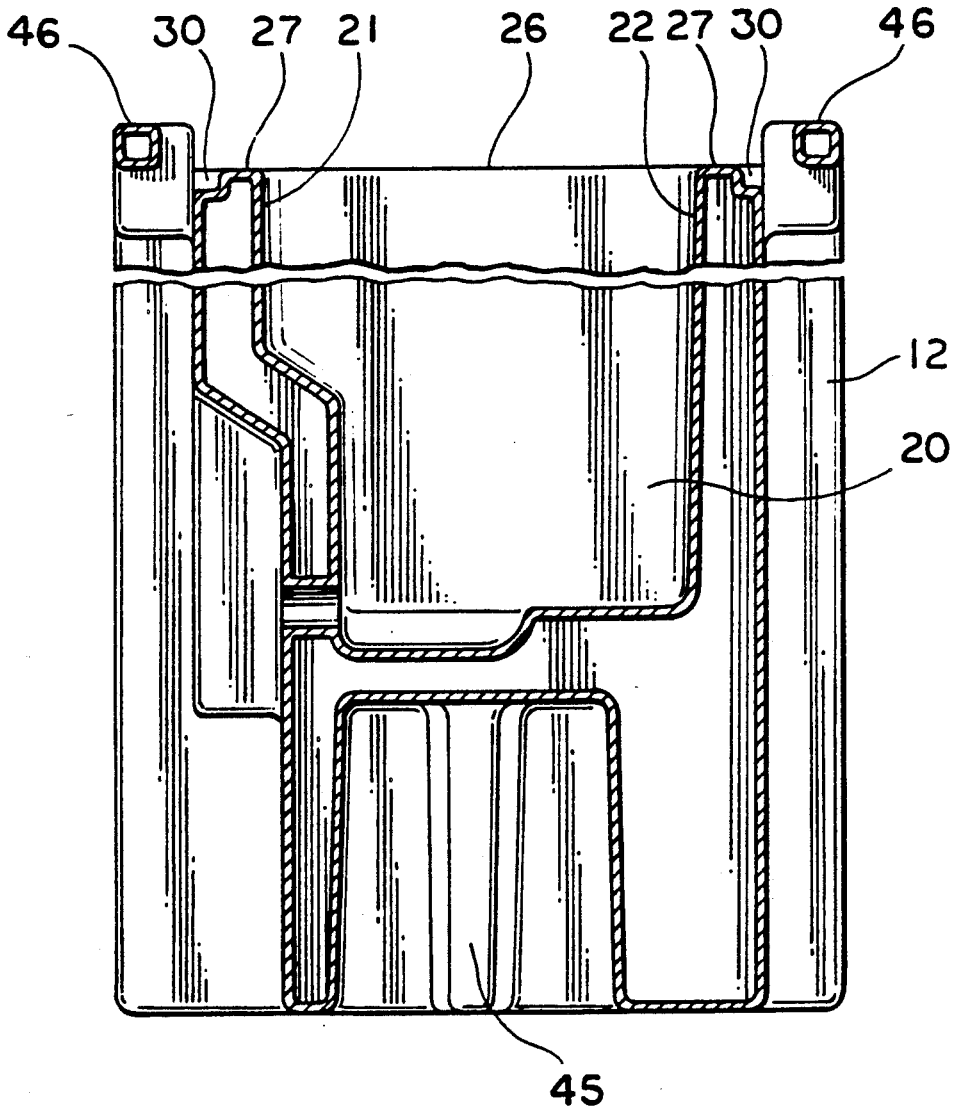
FIG. 3 is a sectional, side elevational view of the base of FIG. 1.
Figure 5:
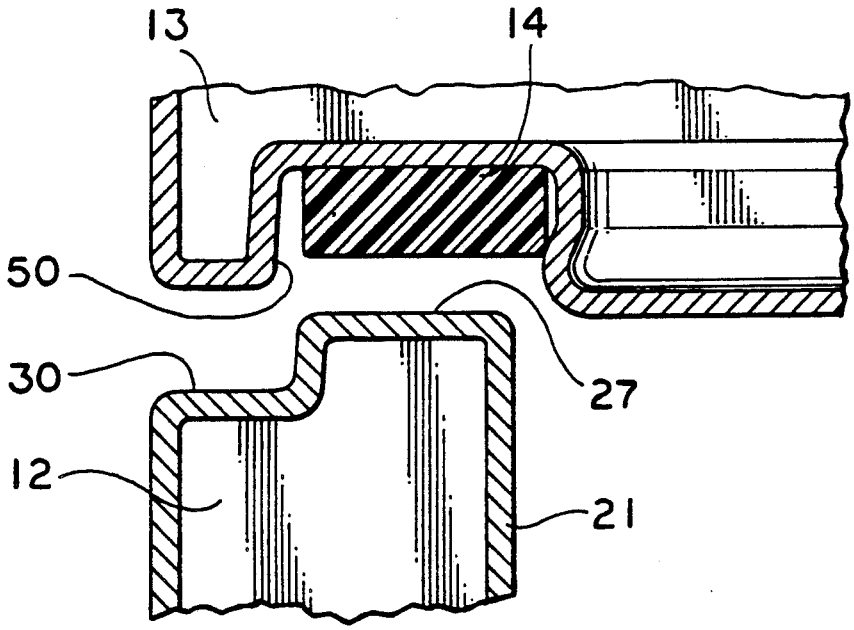
FIG. 5 is a partial, sectional, side view of the gasketing system of FIG. 1.
Figure 6:
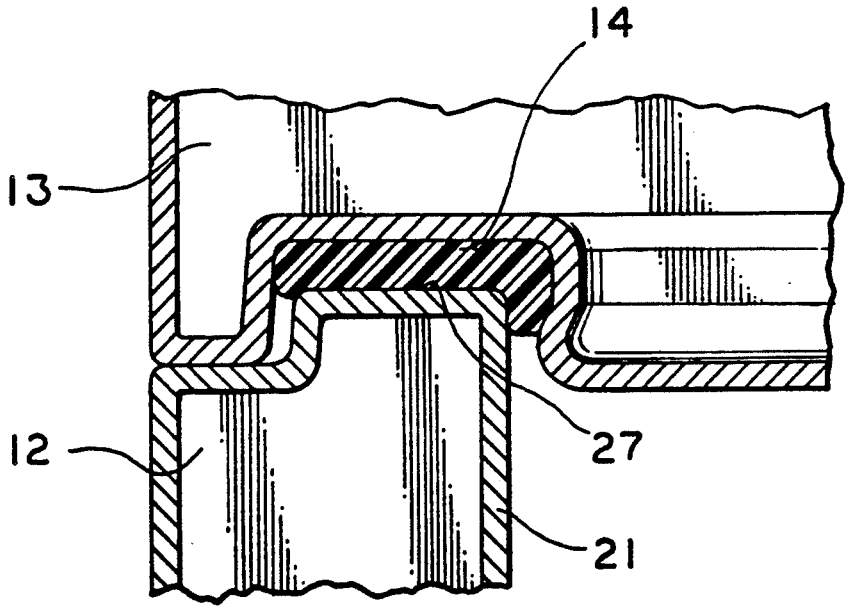
FIG. 6 is a view similar to FIG. 5, and showing the cover in place on the base and the gasket therebetween.

Further, for the sake of this disclosure only, container 11 is depicted as being a beverage container. As such, it is shown having a spigot 44 for draining the container. Such spigots are well known in the art, and do not form a limitation of the present invention. Further, base 11 may also be provided with strengthening legs 45, (FIG. 3), and handles 46 (FIG. 1).

Cover 13 is also provided with at least one and preferably two retaining walls 50. Retaining walls 50 are configured so that when cover 13 is affixed to base 12, retaining walls 50 are receivable within retaining wall grooves 30 of base 12. Gasket 14 is placed on gasket seat 27 of base 12, and when cover 13 is affixed to base 12, retaining wall 50 is received within retaining wall groove 30, and the top and bottom of gasket 14 are impinged between base 12 and cover 13, respectively. In this position retaining walls 50 are positioned outwardly of gasket 14, that is, on the opposite side thereof from opening 26.

In use, a liquid is placed in enclosed area 20 of the container 11, and cover 13 is secured to base 12 with gasket 14 impinged therebetween. If container 11 is then dropped, a sudden increase in internal pressure could result. The pressure will generally be insufficient to cause latch hooks 40 to open, and thus cover 13 will not be separated from its position on base 12. However, the pressure increase will cause a force to be exerted onto gasket 14. The force exerted onto gasket 14 will cause it to move outward and away from enclosed area 20. Gasket 14 will then encounter retaining wall 50, and the outward movement of gasket 14 will be halted, thus preventing a blow-out.

On the sides of the base 12 defined by second opposing pairs of sidewalls 23 and 24, a blow out is prevented when the gasket 14 encounters latch hooks 40, thus also preventing outward movement of gasket 14.

Outward movement of gasket 14 is thus effectively controlled on all sides of base 12, and the seal created by gasket 14 being impinged between base 12 and cover 13 is effectively maintained. Contained liquid is thereby prevented from escaping enclosed area 20, without the use of an obtrusive locking mechanism beyond what is normally associated with containers such as container 11.

It should thus be evident that a shock resistant gasketing system for a liquid container as disclosed herein can be economically fabricated using existing molding technology, which system will effectively prevent a gasket blow-out even if the liquid container is dropped resulting in a sudden increase in internal pressure. Thus the invention disclosed herein and defined by the following claims accomplishes the objects of the present invention and otherwise constitutes an advantageous contribution to the art.

I claim:

1. A container with a shock resistant gasketing system comprising a resilient gasket, a base having an enclosed area and substantially four sides, a rim defining an opening into said enclosed are and having a retaining wall groove on only two of said substantially four sides, said rim also having a gasket seat contiguous with said opening into said enclosed area and contiguous with said retaining wall groove, a cover affixable to said base and closing said opening into said enclosed area when said cover is affixed to said base, means for securing said cover to said base, said cover having a retaining wall structurally corresponding to said retaining wall groove of said base, such that said retaining wall fits within said retaining wall groove when said cover is affixed to said base, wherein said gasket is positioned on said gasket seat and impinged between said base and said cover when said cover is affixed to said base.

2. A gasketing system as in claim 1 wherein said retaining wall groove is positioned outwardly of said gasket when said cover is affixed to said base.

3. A gasketing system as in claim 1, wherein said cover has substantially four sides corresponding to said four sides of said base.

4. A gasketing system as in claim 3, wherein said cover has said retaining walls in two of said four sides of said cover.

5. A gasketing system as in claim 4, wherein said means for securing said cover to said base includes latch-hooks in operative communication between said base and said cover.

6. A gasketing system as in claim 5, wherein said latch-hooks operatively communicate between said base and said cover on two of said four sides of said base and two of said four sides of said cover.

7. A gasketing system as in claim 1, wherein said cover further includes a vent.

8. A container with a shock resistant gasketing system comprising a resilient gasket, a base having an enclosed are and a plurality of sidewalls, a rim defining an opening into said enclosed area, said rim having a retaining wall groove on only two of the said plurality of sidewalls, said rim also having a gasket seat contiguous with said opening into said enclosed area and contiguous with said retaining wall groove, a cover affixable to said base and closing said opening into said enclosed are when said cover is affixed to said base, means for securing said cover to said base, said cover having a retaining wall structurally corresponding to said retaining wall groove of said base, such that said retaining wall fits within said retaining wall groove when said cover is affixed to said base, wherein said gasket is positioned on said gasket seat and impinged between said base and said cover when said cover is affixed to said base.

9. A gasketing system as in claim 8, wherein said sidewalls not having said retaining wall grooves are provided with said means for securing said cover to said base.

* * * * *